US007257491B2

(12) United States Patent
Despax

(10) Patent No.: US 7,257,491 B2
(45) Date of Patent: Aug. 14, 2007

(54) METHOD OF DETERMINING THE PER STRATA RESERVE QUALITY OF AN OIL WELL

(75) Inventor: Damien Despax, Aix-en-Provence (FR)

(73) Assignee: Sondex PLC, Hook (GB)

( * ) Notice: Subject to any disclaimer, the term of this patent is extended or adjusted under 35 U.S.C. 154(b) by 35 days.

(21) Appl. No.: 10/515,398

(22) PCT Filed: May 19, 2003

(86) PCT No.: PCT/FR03/01507

§ 371 (c)(1),
(2), (4) Date: Jan. 9, 2006

(87) PCT Pub. No.: WO03/098000

PCT Pub. Date: Nov. 27, 2003

(65) Prior Publication Data

US 2006/0129321 A1 Jun. 15, 2006

(30) Foreign Application Priority Data

May 22, 2002 (FR) ..... 02 06189

(51) Int. Cl.

| | |
|---|---|
| ***G01V 9/00*** | (2006.01) |
| ***G01L 9/00*** | (2006.01) |
| *E21B 49/00* | (2006.01) |
| *E21B 47/06* | (2006.01) |

(52) U.S. Cl. ..... 702/13

(58) Field of Classification Search ..... 702/6, 702/12, 13; 703/10

See application file for complete search history.

(56) References Cited

U.S. PATENT DOCUMENTS 3,559,476 A 2/1971 Kuo et al.
6,801,857 B2 10/2004 Despax et al.

FOREIGN PATENT DOCUMENTS

FR 2678679 A1 1/1993
FR 2817587 A1 6/2002
WO WO 93/01391 1/1993

OTHER PUBLICATIONS

Copy of International Search Report for PCT/FR03/01507 dated Oct. 9, 2003 (2 pages).

*Primary Examiner*—D. McElheny, Jr.
(74) *Attorney, Agent, or Firm*—Flynn, Thiel, Boutell & Tanis, P.C.

(57) ABSTRACT

The present invention relates to a method of evaluating the hydraulic potential of a porous stratum defined between two depths $z_{low}$ and $z_{high}$, the method consisting in generating periodic modulation in the rate of flow from the well, in lowering down the well and in activating for a few periods at the depth $z_{low}$ a measuring PLT sonde, in extracting from the resulting measurements the amplitude $\Delta Q_{low}$ of the sinusoidal component of the flow rate modulation relating to one of the imposed periods T, the amplitude $\Delta P_{low}$ of the sinusoidal component of the pressure modulation relating to the same period T, and the phase delay of the pressure sinewave relative to the flow rate sinewave $\phi_{low}$, in determining the response $$R_{low} = \frac{\Delta P_{low}}{\Delta Q_{low}} e^{-i\varphi_{low}}$$

in raising the sonde to depth $z_{high}$, and in determining the complex response $$R_{high} = \frac{\Delta P_{high}}{\Delta Q_{low}} e^{-i\varphi_{high}}$$

in calculating the complex response $$R_{stratum} = \frac{R_{high} \cdot R_{low}}{R_{low} - R_{high}}$$

in postulating a physical model for the stratum by numerically inverting the mathematical formula giving the theoretical complex response, in determining the hydraulic characteristics of the stratum defined by the measured response $R_{stratum}$, in calculating the well productivity index $IP_{stratum}$ relating to the stratum in question, and in deducing therefrom the mean deposit pressure $P_D$ in the stratum using the formula:

$$P_D = P_{DH} + \frac{Q_{stratum}}{IP}.$$

1 Claim, No Drawings

METHOD OF DETERMINING THE PER STRATA RESERVE QUALITY OF AN OIL WELL

The present invention relates to methods of determining the reserve quality of an oil well delivering a fluid coming from a productive bed by measuring the response R of the well, and more particularly it relates to a method of evaluating the hydraulic potential (in the simplest case, determining the mean permeability or transmissivity, the damage skin, and the local pressure of the deposit) of the section of a porous stratum that is filled with an incoming or outgoing moving effluent and that is defined by two depths, respectively $z_{low}$ and $z_{high}$.

It is known that the production quality of an oil well is represented essentially by the productivity index IP of the well, which depends on the radius of the well $r_w$, the drainage radius $R_e$ of the well, the viscosity μ of the recoverable oil, and also the transmissivity of the productive layer, which is defined as the product of its permeability k multiplied by its height h, and possibly also on any clogging of the pores in the rock in the vicinity of the wall of the well which is quantified by a dimensionless parameter S commonly referred to by the person skilled in the art under the generic term "skin". This productivity index is given by the following formula:

$$IP = \frac{2\pi kh}{\mu\left[\ln\left(\frac{R_e}{r_w}\right) - 0.75 + S\right]}$$

where ln represents the natural logarithm. The productivity index IP is a direct measure of the ease with which oil can flow into the well under the effect of a drop ΔP in the mean pressure of the deposit around the well, since the flow rate Q of the well as measured in downhole conditions is then equal merely to:

$$Q = \mathrm{IP}.\Delta P$$

This downhole flow is then evacuated to the surface using means that are known in themselves. In order to optimize production from a well, in particular an oil well, it is therefore useful to know its reserve quality, in particular by determining the values of certain defined parameters. Referring to the expression for the productivity index IP given above, a first important parameter is the permeability k of the productive layer of the subsoil in which the well has been drilled, and another is the "skin" S which quantifies possible damage to the productive layer. It is thus possible to establish two classes of well from which production is low: wells that are maintained under ideal operating conditions (S=0) but which are taking oil from rock that has low permeability; and wells drilled in deposits presenting high permeability, but which have become clogged (S>0) and which could produce more after being restored by using techniques that are themselves known.

It is therefore important to be able to detect the formation of a layer of clogging in order to take effective action as soon as possible to eliminate that layer and to continue working the well.

Various methods have been developed for monitoring the production quality of a well. Most of the old methods are based on using empirical or statistical relationships between various measurements that can be performed on such a well. Another method giving results that are more accurate consists in completely closing the outlet of the well and in studying the rise in the pressure of the oil in the well as a function of closure time, where examination of curves plotting variation in said pressure makes it possible to deduce whether the well is in its ideal state or whether it is clogged.

That method makes it possible to obtain good results, but it presents the major drawback of being lengthy to implement. In order to obtain a curve that is useful, it is necessary to wait for several hours, or even several days with some wells, during which time the well is not in use, thus constituting certain loss of production, to which there needs to be added the cost of restarting when the pressure of the deposit is no longer sufficient for the well to remain eruptive.

To mitigate that drawback, attempts have been made to develop another method which consists in modulating closure of the well at its outlet and in studying the variation in the pressure of the fluid as a function of such modulation. That method eliminates the above-mentioned drawback of total closure of the well, but presents the drawback of leading to measurements that are not sufficiently accurate.

For example, another method is described in U.S. Pat. No. 3,559,476 and FR-A-2 678 679. It consists in modulating the flow rate of the fluid in the well by means of a sinewave function and in measuring the variations in the flow rate and the pressure of the fluid, from which the response R of the well is deduced in certain special cases.

That method gives results that are relatively satisfactory when the damage to the well consists in its wall being clogged so as to give a positive "skin" value, and providing the "skin" has thickness that can be assumed to be zero. Clearly that type of infinitely thin "skin" is merely a convenient mathematical abstraction which is often satisfactory, but other types of damage can exist which correspond to a positive value for the "skin" but for which the thickness of the "skin" cannot be taken as being zero, or which correspond to a negative value for the "skin", for example when a well is connected to a network of natural cracks that are open or when a well is being stimulated by hydraulic fracturing, i.e. has an artificially induced fracture passing through it, which fracture is generally symmetrical relative to the axis of the well.

Also already known is a method of determining the reserve quality of an oil well or the like delivering a given fluid coming from a productive layer, by measuring the response R of the well, said method consisting in modulating the flow rate of the fluid in the well by means of a sinewave function, and in measuring the variations in the flow rate and the pressures of the fluid, the method being characterized by the fact that:

I) the response Rc of the well when said productive layer includes a damaged zone presenting a positive "skin" value S for "skin" of non-zero thickness is obtained by the equation:

$$R_c = \frac{D_{R_0}(\beta_{z_w}) - B}{-C_{R_0}(\beta_{z_w}) + A},$$

and that

II) the response Rf of the well when the productive layer has a fracture presenting a negative "skin" value S is obtained by the equation:

$$R_f = \frac{\pi}{F_{CD}\sqrt{\frac{i^2_{Zf}}{E_{fD}} + \frac{2\sqrt{i}\,z_f}{F_{CD}}}} + S_{wf}$$

in which equations:

A, B, C, and D are functions of the parameters $z_w$, $\alpha$, and $\beta$, as defined below, and are respectively defined by the following four equations:

$$A(z_w, \alpha, \beta) = i\frac{z_w}{\sqrt{\alpha}}e^{\frac{i\pi}{4}}\left[kelbe_0\frac{\beta z_w}{\sqrt{\alpha}}kelke_1\left(\frac{z_w}{\sqrt{\alpha}}\right) - kelbe_1\left(\frac{z_w}{\sqrt{\alpha}}\right)kelke_0\left(\frac{\beta z_w}{\sqrt{\alpha}}\right)\right]$$

$$B(z_w, \alpha, \beta) = \frac{1}{\alpha}\left[kelbe_0\left(\frac{z_w}{\sqrt{\alpha}}\right)kelke_0\left(\frac{\beta z_w}{\sqrt{\alpha}}\right) - kelbe_0\left(\frac{\beta z_w}{\sqrt{\alpha}}\right)kelke_0\left(\frac{z_w}{\sqrt{\alpha}}\right)\right]$$

$$C(z_w, \alpha, \beta) = i\beta z_w^2\left[kelbe_1\left(\frac{z_w}{\sqrt{\alpha}}\right)kelke_1\left(\frac{\beta z_w}{\sqrt{\alpha}}\right) - kelbe_1\left(\frac{\beta z_w}{\sqrt{\alpha}}\right)kelke_1\left(\frac{z_w}{\sqrt{\alpha}}\right)\right]$$

$$D(z_w, \alpha, \beta) = i\frac{\beta z_w}{\sqrt{\alpha}}e^{\frac{i\pi}{4}}\left[kelbe_0\left(\frac{z_w}{\sqrt{\alpha}}\right)kelke_1\left(\frac{\beta z_w}{\sqrt{\alpha}}\right) - kelbe_1\left(\frac{\beta z_w}{\sqrt{\alpha}}\right)kelke_0\left(\frac{z_w}{\sqrt{\alpha}}\right)\right]$$

it being specified that in the equations given above:

$$kelke_n(x) = ker_n(x) + i\ kei_n(x)$$

and $$kelbe_n(x) = ber_n(x) + i\ bei_n(x)$$

where i is the imaginary unit number in the mathematical theory of complex numbers and where $ker_n$, $kei_n$, $ber_n$, and $bei_n$ are Kelvin functions;

$$\alpha = \frac{k_s}{k}$$

is the non-dimensional permeability of the damaged zone, $k_s$ representing the permeability of the damaged zone, and k representing the permeability of the productive layer;

$$\beta = \frac{r_s}{r_w}$$

is the non-dimensional radius of the damaged zone, $r_s$ representing the radius of the damaged zone, and $r_w$ representing the radius of the well;

$$z_w = r_w\sqrt{\frac{\omega}{\delta}}$$

where $\omega$ is the angular frequency of the sinewave function and $\delta$ is the diffusivity of the productive layer equal to $$\frac{k}{\varphi\mu c_t},$$

$\phi$ representing the porosity of the productive layer, $\mu$ representing the viscosity of the fluid, and $c_t$ representing the total compressibility of the fluid;

$$R_0 = \frac{K_0(\sqrt{i}\,z_w)}{\sqrt{i}\,z_w K_1(\sqrt{i}\,z_w)}$$

where $K_0$ and $K_1$ are modified Hankel functions; and also with $$z_f = x_f\sqrt{\frac{\omega}{\delta}}$$

where $x_f$ is the length of one of the wings of the fracture which is assumed to have two wings; $F_{CD}$ is the non-dimensional conductivity of the fracture represented by the formula $$\frac{k_f w}{k x_f},$$

where $k_f$ represents the permeability of the material supporting the fracture and w represents the mean thickness of the supported fracture;

$$E_{fD} = \frac{k_f \varphi c_t}{k \varphi_f c_{tf}}$$

is the non-dimensional diffusivity of the fracture, $\phi_f$ representing the porosity of the support material filling the fracture, and $C_{tf}$ representing the total compressibility of the fluid in the fracture; $S_{wf}$ is a "skin" if any, existing between the bottom of the well and the entry of the fracture.

The present invention thus has the object of improving prior methods and in particular those defined above in order to evaluate the reserve quality of an oil well or the like and to implement a method which, while remaining easy to implement, makes it possible to obtain said evaluation at all of the levels of the well and regardless of the type of damage to the productive bed, by using measurements which can be interpreted with low error percentage or uncertainty, and more precisely a method of evaluating the hydraulic potential (in the simplest case, determining the mean permeability or transmissivity, the damage skin, and the local pressure of the deposit) of the section of a porous stratum that is filled with an incoming or outgoing moving effluent and that is defined by two depths, respectively $z_{low}$ and $z_{high}$.

More precisely, the present invention provides a method of evaluating the hydraulic potential of the section of a porous stratum that is filled with an incoming or outgoing moving effluent and that is defined by two depths respectively $z_{low}$ and $z_{high}$, the method being characterized in that it consists:

in generating periodic modulation of the flow rate of the well;

in lowering down the well and in activating for a few periods at the fixed depth $z_{low}$ a sonde provided:

i) with a device for precisely determining depth, either relative to the geological series by a gamma ray detector or relative to elements of the well (CCL);

ii) with a clock; and iii) with physical sensors suitable for measuring at least the flow of effluent in the well, the pressure, the temperature, the mean density, and the head loss gradient;

in extracting from these measurements:

i) the amplitude $\Delta Q_{low}$ of the sinusoidal component of the flow rate modulation relative to one of the imposed periods T;

ii) the amplitude $\Delta P_{low}$ of the sinusoidal component of the pressure modulation relative to the same period; and iii) the phase delay of the pressure sinewave relative to the flow rate sinewave $\phi_{low}$;

in determining the complex response $R_{low}$ to the cyclical test of period T of all of the active zones delivering effluent into the well between the bottom of the well and the depth $z_{low}$, by using the formula;

$$R_{low} = \frac{\Delta P_{low}}{\Delta Q_{low}} e^{-i\varphi_{low}}$$

in raising the sonde to the depth $z_{high}$, activating it for a few periods at said depth, performing new measurements, and from the new measurements, extracting:

i) the amplitude $\Delta Q_{high}$ of the sinusoidal component of the flow rate modulation relating to the imposed period T;

ii) the amplitude $\Delta P_{high}$ of the sinusoidal component of the pressure modulation relating to the same period T; and iii) the phase delay of the pressure sinewave relative to the flow rate sinewave $\phi_{high}$;

in determining the complex response $R_{high}$ of all of the active zones delivering effluent into the well between the bottom of the well and the depth $z_{high}$, by using the formula:

$$R_{high} = \frac{\Delta P_{high}}{\Delta Q_{high}} e^{-i\varphi_{high}}$$

in calculating the complex response $R_{stratum}$ of the stratum defined by the fact that the effluent it contains is delivered into the well between the depths $z_{low}$ and $z_{high}$, by means of the formula;

$$R_{stratum} = \frac{R_{high} \cdot R_{low}}{R_{low} - R_{high}}$$

in postulating a physical model for the stratum by numerically inverting the mathematical formula giving the theoretical complex response;

in determining the hydraulic characteristics of the stratum defined by the measured response $R_{stratum}$;

in calculating the well productivity index $IP_{stratum}$ relating to the stratum in question and in deducing therefrom the mean deposit pressure $P_D$ in the stratum, by applying the formula:

$$P_D = P_{DH} + \frac{Q_{stratum}}{IP}$$

given that using the sonde, and prior to activating the flow rate modulator, both the stabilized downhole pressure $P_{DH}$ and the net flow rate $Q_{stratum}$ coming from the stratum are measured.

Other characteristics and advantages of the present invention appear from the description given below.

It is known that an oil well is dug in ground down to productive beds or strata containing oil. In general, such beds are formed of permeable sands or rocks and they are situated beneath impermeable beds. The oil is thus confined in the permeable beds and can be extracted providing the well penetrates as far as them. To implement the method of the invention, as described above, a sonde known as a production logging tool (PLC) is used, which tool is well known to the person skilled in the petroleum art and it comprises in particular:

A controllable shutter suitable for modulating the value of the flow section in the duct formed by the well through the oil-bearing beds. This controllable shutter may be constituted, for example, by a sleeve having fins that can be deployed by means of a motor from a remote point. It may also be constituted by a plurality of walls arranged relative to one another to form a cone of varying angle, with the sliding of the walls relative to one another being controllable by means of a cable for applying traction.

A flow meter for measuring the flow of fluid flowing in the duct of the well. Such a flow meter is known in itself and can be constituted in outline by a sleeve having a measuring device including a propeller or "spinner" as it is known in the art, disposed therein, together with means for counting the number of revolutions performed by the spinner per unit time, the sleeve may optionally be associated with a deflector in order to pick up all of the fluid flowing in the duct and force it to pass entirely through the sleeve. The flow meter is arranged to output a signal representative of the flow rate of the fluid passing through it.

A well-known pressure sensor, e.g. constituted by strain gauges based on a mineral crystal such as quartz or sapphire or the like. It serves to output a signal representative of the pressure of the fluid in the duct.

In order to implement the method of the invention, those three elements are assembled together so as to enable them to be lowered from the well head by any connection means, e.g. a cable or the like, down to the level of the productive beds. The elements are also associated in such a manner that when they are lowered down the well, the flow meter and the pressure sensor are situated beneath the controllable shutter. In addition, those three elements are connected to a bus line which makes it possible from a processor member to control the shutter, optionally to put the flow meter and the pressure sensor into operation, and also to receive and process the signals issued by those two elements.

It is also stated that in addition to the three above-defined elements, in order to acquire data, a clock is also provided which specifies a unique time associated with each fluid pressure and flow rate measurement.

Once the above-described tool has been lowered down the well, to a determined level of the productive bed, the method consists initially in controlling the shutter so as to vary the flow section of the duct between a minimum value and a maximum value in application of a sinusoidal mathematical relationship having an angular frequency ω, the minimum value not being zero so as to ensure that the duct is never completely closed off, thus allowing fluid to continue flowing throughout the time measurements are being taken.

In the event of the flow meter and the pressure sensor not being switched on permanently, they are switched on for a few periods of the mathematical function with which the shutter is controlled. They output respective signals representative of variations in fluid pressure and flow rate in the well below the shutter, but at the level of the locations of the other two elements.

It is found that the curves of these variations are sinusoidal functions of the same period T as that with which the shutter is controlled, but that they are phase-shifted relative to each other. Combined measurements of the phase shift between these two signals and the ratio of their respective amplitudes makes it possible to deduce simultaneously a value which is representative of the permeability of the productive beds beneath the controllable shutter and situated between the level of the flow meter and the bottom of the well, and also a value which is representative of clogging.

This method is advantageous for two reasons, since in addition to making it possible to evaluate the permeability and the clogging within each oil-bearing bed, and thereby eliminate a number of uncertainties inherent to prior art methods, it also makes it possible to evaluate this permeability and clogging at all levels of a productive bed, it being recalled that the term "clogging" is used to mean the phenomenon which slows down the flow of oil and that presents a positive value for the "SKIN" S (which value is an image of resistance to flow). The term "fracture" is used to designate means that encourage productivity of the well, by presenting a negative value for "SKIN" S (an image of reduced resistance to fluid flow).

The method of the invention for evaluating hydraulic potential (in the simplest case, determining the mean permeability or transmissivity, the damage skin, and the local pressure of the deposit) of the section of a porous stratum that is filled with an incoming or outgoing moving effluent as defined by two depths respectively $z_{low}$ and $z_{high}$ consists:

in generating periodic modulation of the flow from the well, which modulation is not necessarily sinusoidal, and could be a superposition of periodic modulations having different periods. This modulation may be obtained using either a direct or an indirect mechanical device that can be adjusted or servo-controlled and that is programmable, that is independent of the above-described sonde, and that is and placed on the tubing production line anywhere downstream from the flow rate sensors when the effluent is outgoing or upstream when the effluent is incoming, i.e. either in the open hole section, in the "casing", or in the lost column or "liner" cemented beneath the annular production shutter known as the "production packer" or in the production column between the annular shutter and the well head, or indeed in the well head itself, or even in the line connecting the well as the case may be to a test separator or to a collecting network. The modulation may also be obtained by a mechanical device that is adjustable or servo-controlled and programmable and advantageously placed at the top of the sonde. As the above-mentioned direct device, it is possible to use a "duse", i.e. an adjustable pump that is programmable from the surface (the most practical), or optionally in the well for an anchored PLT with memory. An above-mentioned indirect device is constituted, for example, by a servo-controlled pump that is programmable to inject or draw fluid at the surface;

in lowering down the well and activating for a few periods at a fixed depth $z_{low}$, a PLT or a precise PLT sonde provided i) with a device for precisely determining depth either relative to the geological series by a gamma ray detector or relative to an element of the well known as a casing collar locator (CCL); ii) a clock; iii) various physical sensors enabling it to measure certain characteristics of the flow of effluent in the well, and in particular its total flow rate, gas flow rate, liquid flow rate, water flow rate, hydrocarbon flow rate, pressure, temperature, mean density, or head loss gradient; and iv) either a memory enabling it to store the measured values as a function of time ("PLT with memory" lowered using a steel line known as a "slick line" and suspended or anchored in a seat), or else a device capable of sending measurements in real time to a computer on the surface, such as an electric cable or an optical cable or a radio or sound transmitter;

in extracting from these recordings: i) the amplitude $\Delta Q_{low}$ of the sinusoidal component of the modulation of the flow rate relative to one of the imposed periods T; ii) the amplitude $\Delta P_{low}$ of the sinusoidal component of the pressure modulation relating to the same period T; and iii) the phase delay of the pressure sinewave relative to that of the flow rate $\phi_{low}$; and in determining the complex response $R_{low}$ to the cyclical test of period T of all of the active zones delivering effluent into the well between the bottom of the well and the depth $z_{low}$, by using the formula:

$$R_{low} = \frac{\Delta P_{low}}{\Delta Q_{low}} e^{-i\varphi_{low}}$$

and then in raising the sonde to the depth $z_{high}$ and activating it during a few periods at said depth;

in extracting from the information measured by the elements making up the sonde: i) the amplitude $\Delta Q_{high}$ of the sinusoidal component of the flow rate modulation relating to the imposed period T; ii) the amplitude $\Delta P_{high}$ of the sinusoidal component of the pressure modulation relating to the same period T; and iii) the phase delay of the pressure sinewave relative to that of the flow rate $\phi_{high}$; and in determining the complex response $R_{high}$ of all of the active zones delivering effluent into the well between the bottom of the well and the depth $z_{high}$, by using the formula:

$$R_{high} = \frac{\Delta P_{high}}{\Delta Q_{high}} e^{-\alpha\varphi_{high}}$$

and then in calculating the complex response $R_{stratum}$ of the stratum defined by the fact that the effluent it contains is delivered into the well between the depths $z_{low}$ and $z_{high}$, by using the formula:

$$R_{stratum} = \frac{R_{high} \cdot R_{low}}{R_{low} - R_{high}}$$

By assuming a physical model for the stratum (in the simplest case: an infinite uniform bed of permeability k and of damage skin S), by numerically inverting the mechanical formula giving the theoretical complex response, it is possible to determine the hydraulic characteristics of the stratum defined by the measured response $R_{stratum}$; in the simplest case, the mean permeability k and the damage skin SKIN S are determined.

By relying on this physical model and also on the shape of the drainage area, it is possible to calculate the productivity index of the well $IP_{stratum}$ relating to the stratum in question, and to deduce therefrom the mean deposit pressure $P_D$ in the stratum by applying the formula:

$$P_D = P_{DH} + \frac{Q_{stratum}}{IP}$$

since by using the sonde, and prior to activating the flow rate modulator, both the stabilized downhole pressure $P_{DH}$ and the net flow rate $Q_{stratum}$ coming from the stratum have been measured.

The invention claimed is:

1. A method of evaluating the hydraulic potential of the section of a porous stratum that is filled with an incoming or outgoing moving effluent and that is defined by two depths respectively $z_{low}$ and $z_{high}$, the method being characterized in that it consists:

in generating periodic modulation of the flow rate of the well;

in lowering down the well and in activating for a few periods at the fixed depth $z_{low}$ a sonde provided:

i) with a device for precisely determining depth, either relative to the geological series by a gamma ray detector or relative to elements of the well (CCL);

ii) with a clock; and iii) with physical sensors suitable for measuring at least the flow of effluent in the well, the pressure, the temperature, the mean density, and the head loss gradient;

in extracting from these measurements:

i) the amplitude $\Delta Q_{low}$ of the sinusoidal component of the flow rate modulation relative to one of the imposed periods T;

ii) the amplitude $\Delta P_{low}$ of the sinusoidal component of the pressure modulation relative to the same period; and iii) the phase delay of the pressure sinewave relative to the flow rate sinewave $\phi_{low}$;

in determining the complex response $R_{low}$ to the cyclical test of period T of all of the active zones delivering effluent into the well between the bottom of the well and the depth $z_{low}$, by using the formula;

$$R_{low} = \frac{\Delta P_{low}}{\Delta Q_{low}} e^{-i\varphi_{low}}$$

in raising the sonde to depth $z_{high}$, activating it for a few periods at said depth, performing new measurements, and from the new measurements, extracting:

i) the amplitude $\Delta Q_{high}$ of the sinusoidal component of the flow rate modulation relating to the imposed period T;

ii) the amplitude $\Delta P_{high}$ of the sinusoidal component of the pressure modulation relating to the same period T; and iii) the phase delay of the pressure sinewave relative to the flow rate sinewave $\phi_{high}$;

in determining the complex response $R_{high}$ of all of the active zones delivering effluent into the well between the bottom of the well and the depth $z_{high}$, by using the formula:

$$R_{high} = \frac{\Delta P_{high}}{\Delta Q_{high}} e^{-\alpha\varphi_{high}}$$

in calculating the complex response $R_{stratum}$ of the stratum defined by the fact that the effluent it contains is delivered into the well between the depths $z_{low}$ and $z_{high}$, by means of the formula:

$$R_{stratum} = \frac{R_{high} \cdot R_{low}}{R_{low} - R_{high}}$$

in postulating a physical model for the stratum by numerically inverting the mathematical formula giving the theoretical complex response;

in determining the hydraulic characteristics of the stratum defined by the measured response $R_{stratum}$;

in calculating the well productivity index $IP_{stratum}$ relating to the stratum in question and in deducing therefrom the mean deposit pressure $P_D$ in the stratum, by applying the formula:

$$P_D = P_{DH} + \frac{Q_{stratum}}{IP}$$

given that using the sonde, and prior to activating the flow rate modulator, both the stabilized downhole pressure $P_{DH}$ and the net flow rate $Q_{stratum}$ coming from the stratum are measured.

* * * * *